US006470783B2

(12) United States Patent
Ito et al.

(10) Patent No.: US 6,470,783 B2
(45) Date of Patent: Oct. 29, 2002

(54) INSTALLATION FOR DISMANTLING CHEMICAL BOMBS

(75) Inventors: Yutaka Ito, Osaka (JP); Kiyosi Asahina, Osaka (JP); Hirosuke Sone, Kobe (JP); Mizune Sakato, Kobe (JP)

(73) Assignee: Kabushiki Kaisha Kobe Seiko Sho., Kobe (JP)

( * ) Notice: Subject to any disclaimer, the term of this patent is extended or adjusted under 35 U.S.C. 154(b) by 0 days.

(21) Appl. No.: 09/908,777

(22) Filed: Jul. 20, 2001

(65) Prior Publication Data

US 2002/0011172 A1 Jan. 31, 2002

(30) Foreign Application Priority Data

Jul. 24, 2000 (JP) ..... 2000-222447

(51) Int. Cl.[7] ..... F42B 33/06

(52) U.S. Cl. ..... 86/50; 588/200; 588/202; 588/203

(58) Field of Search ..... 102/293; 86/50; 588/202, 203

(56) References Cited

U.S. PATENT DOCUMENTS 3,440,096 A * 4/1969 Scott
4,949,641 A * 8/1990 Sayles ..... 102/293
5,430,228 A * 7/1995 Ciambrone et al. ..... 210/760
5,524,545 A * 6/1996 Miller et al. ..... 102/293
5,584,071 A * 12/1996 Kalyon et al. ..... 588/200
5,737,709 A * 4/1998 Getty et al. ..... 134/22.12
5,781,868 A * 7/1998 Miller et al. ..... 134/22.12
6,080,906 A * 6/2000 Johnson et al. ..... 435/262.5

FOREIGN PATENT DOCUMENTS

DE 3940567 A1 * 6/1991 ..... A62D/3/00
JP 2001-66100 8/1999

OTHER PUBLICATIONS

U.S. Statutory Invention Registration, H1189, Kirts, May 4, 1993.*

* cited by examiner

*Primary Examiner*—Michael J. Carone
*Assistant Examiner*—Troy Chambers

(57) ABSTRACT

The invention provides an installation for dismantling chemical bombs, which can make a toxic chemical agent in a chemical bomb harmless and can dismantle the chemical bomb with safety. The installation for dismantling chemical bombs comprises a container for accommodating the chemical bomb; a bomb holding apparatus including an airtight closing lid to close the container in an airtight sealed condition and a bomb rotating mechanism for rotating the chemical bomb, placed in the container, rotatably about a longitudinal axis thereof; a boring and cutting apparatus having a cutter to bore a cut hole in a body shell of the chemical bomb; and a neutralizer spraying apparatus having a neutralizer spray nozzle inserted in the cut hole bored by the boring and cutting apparatus. The neutralizer is sprayed into the cut hole through the neutralizer spray nozzle to make the chemical agent harmless. The bomb body shell can also be cut by the cutter for dismantling of the chemical bomb while rotating it by the bomb rotating mechanism.

11 Claims, 15 Drawing Sheets

INSTALLATION FOR DISMANTLING CHEMICAL BOMBS

BACKGROUND OF THE INVENTION

1. Field of the Invention

The present invention relates to an installation for dismantling chemical bombs. More particularly, the present invention relates to the technical field of an installation for dismantling chemical bombs, which can make harmless toxic chemical agents, such as mastard and lewisite, filled in body shells of the chemical bombs, thereby dismantling the chemical bombs with safety.

2. Description of the Related Art

There are chemical bombs containing liquid chemical agents, such as mastard and lewisite, which have extremely strong toxicity and exert very bad influences upon human bodies, that is, which not only bring about serious after-effects, but also cause person's deaths. FIG. 24 is an explanatory view, partly sectioned, showing the structure of such a chemical bomb 100. The chemical bomb 100 comprises a warhead 110 to which an explosive tube 111 containing an explosive 112 is attached, the warhead 110 including a fuse 113 for bursting the explosive 112 in the explosive tube 111; a body shell 120 connected to the warhead 110 so as to receive the explosive tube 111 and containing a liquid chemical agent 121, such as mastard and lewisite, filled therein; and posture control blades 130 attached to the bomb body shell 120 on the side opposite to the warhead 110 and controlling a dropping posture of the chemical bomb 100 when it is dropped. Additionally, a lift ring 140 is provided on an upper wall of the bomb body shell 120 to lift up the chemical bomb 100 for loading it in an airplane.

Since production of such a chemical bomb is prohibited at present as well known, most of existing chemical bombs were produced in times past and hence have been appreciably corroded. If those chemical bombs are left as they are, there is a risk in the span of long term that body shells of the chemical bombs will be bored and chemical agents will leak through the bore, thus causing a great deal of harm. In order to prevent the occurrence of harm, the chemical bombs are required to dismantle or treat as early as possible so that the chemical agents are made harmless.

Meanwhile, it is known that liquid chemical agents, such as mastard and lewisite, used in the chemical bombs can be made harmless by neutralizing them with an alkaline solution, such as ammonia and sodium hydroxide.

Thus, chemical bombs were produced in times past and have been left without treatment for making them harmless. This fact means a risk that chemical agents may leak from bomb body shells due to, e.g., corrosion of the chemical bombs. Those chemical bombs, therefore, must be dismantled as early as possible. When dismantling the chemical bombs, safety in the operation is top priority, and in addition high efficiency in the operation is also desired because a very large number of chemical bombs remain to be dismantled.

SUMMARY OF THE INVENTION

Accordingly, it is an object of the present invention to provide an installation for dismantling chemical bombs, which can dismantle a chemical bomb filled with a toxic chemical agent, such as mastard and lewisite, while ensuring safety and high efficiency.

The inventors have accomplished the present invention based on the conception that a chemical bomb can be dismantled with safety and high efficiency by placing the chemical bomb in an airtight sealed space which can be freely established and allows the chemical bomb to be flexibly treated therein, neutralizing the chemical agent while preventing the chemical agent from scattering to the atmosphere, and releasing the chemical bomb after being dismantled from the airtight sealed condition by a simple way.

To achieve the above object based on that conception, according to the present invention, there is provided an installation for dismantling a chemical bomb including a warhead and a body shell integrally joined to the warhead and filled with a chemical agent, the installation comprising a container capable of accommodating the chemical bomb in an airtight sealed condition; a bomb holding apparatus for holding the chemical bomb rotatably about a longitudinal axis thereof and placing the chemical bomb into the container in a removable manner; a boring and cutting apparatus provided on a barrel of the container for boring a cut hole in a body shell of the chemical bomb loaded in the container while being held by the bomb holding apparatus, and/or cutting an outer periphery of the bomb body shell to separate the bomb body shell from the warhead; and a neutralizer spraying apparatus having a neutralizer spray nozzle inserted in the cut hole or portion bored or cut by the boring and cutting apparatus to spray the neutralizer to the interior of the bomb body shell to neutralize the chemical agent so as to become harmless, the sprayed neutralizer being circulated to the neutralizer spray nozzle.

BRIEF DESCRIPTION OF THE DRAWINGS

FIGS. 5A, 5B and 5C show the embodiment of the present invention, in which FIG. 5A is a plan view of bomb support rods provided with a bomb supporting mechanism, FIG. 5B is a side view of the bomb support rods provided with the bomb supporting mechanism which is supporting the chemical bomb, and FIG. 5C is a sectional view taken along the line VC—VC in FIG. 5B;

FIGS. 6A, 6B and 6C show the embodiment of the present invention, in which FIG. 6A is a plan view of a barrel holder, FIG. 6B is a side view of the barrel holder, and FIG. 6C is a sectional view taken along the line VIC—VIC in FIG. 6B;

DESCRIPTION OF THE PREFERRED EMBODIMENTS

Figure 1:
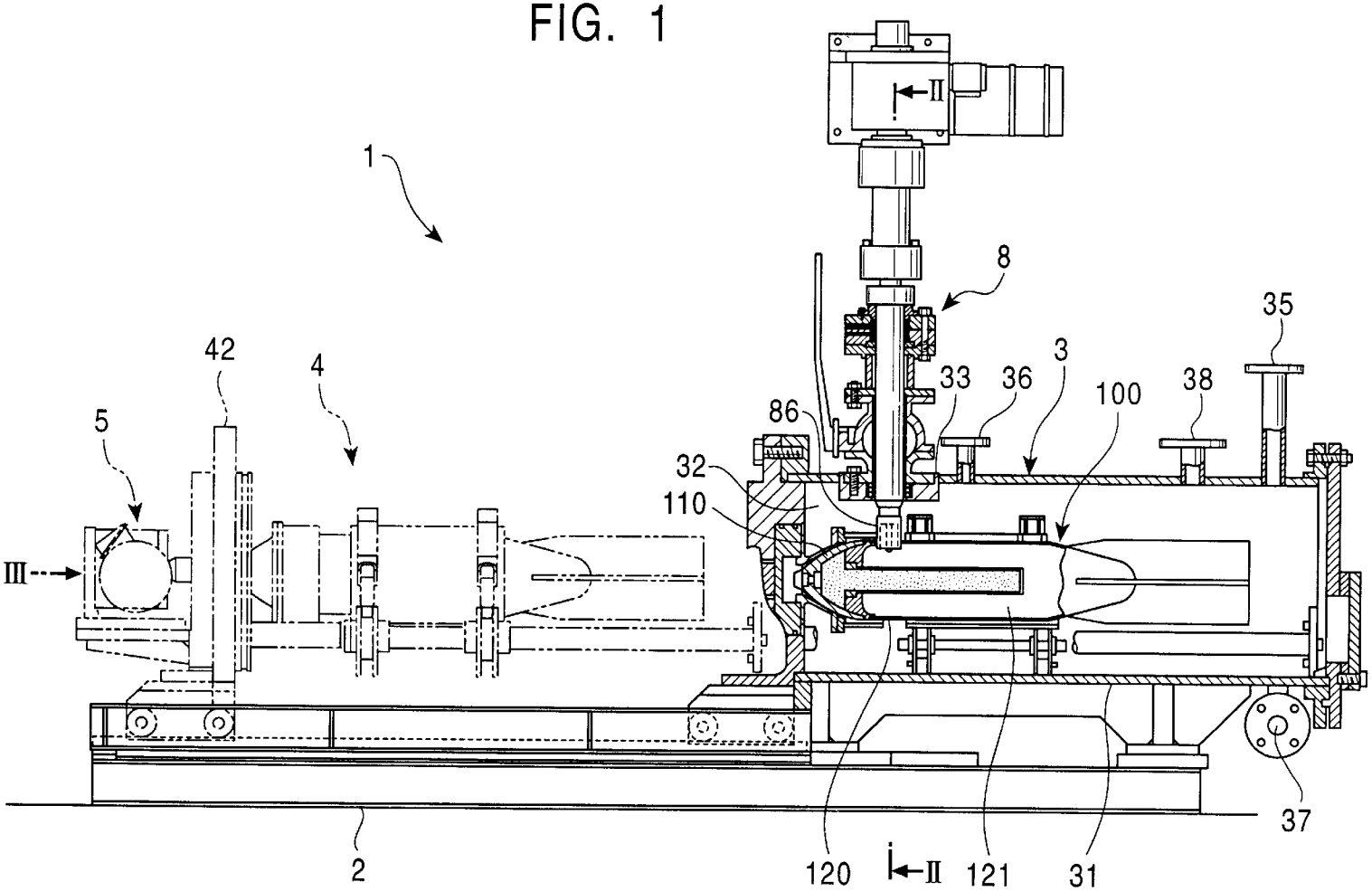
FIG. 1 is an explanatory view, sectioned in principal parts, of the overall construction of an installation for dismantling chemical bombs according to an embodiment of the present invention, showing a state where the chemical bomb is placed in a container and a state where the chemical bomb is withdrawn out of the container after a bomb body shell has been cut.
Figure 2:
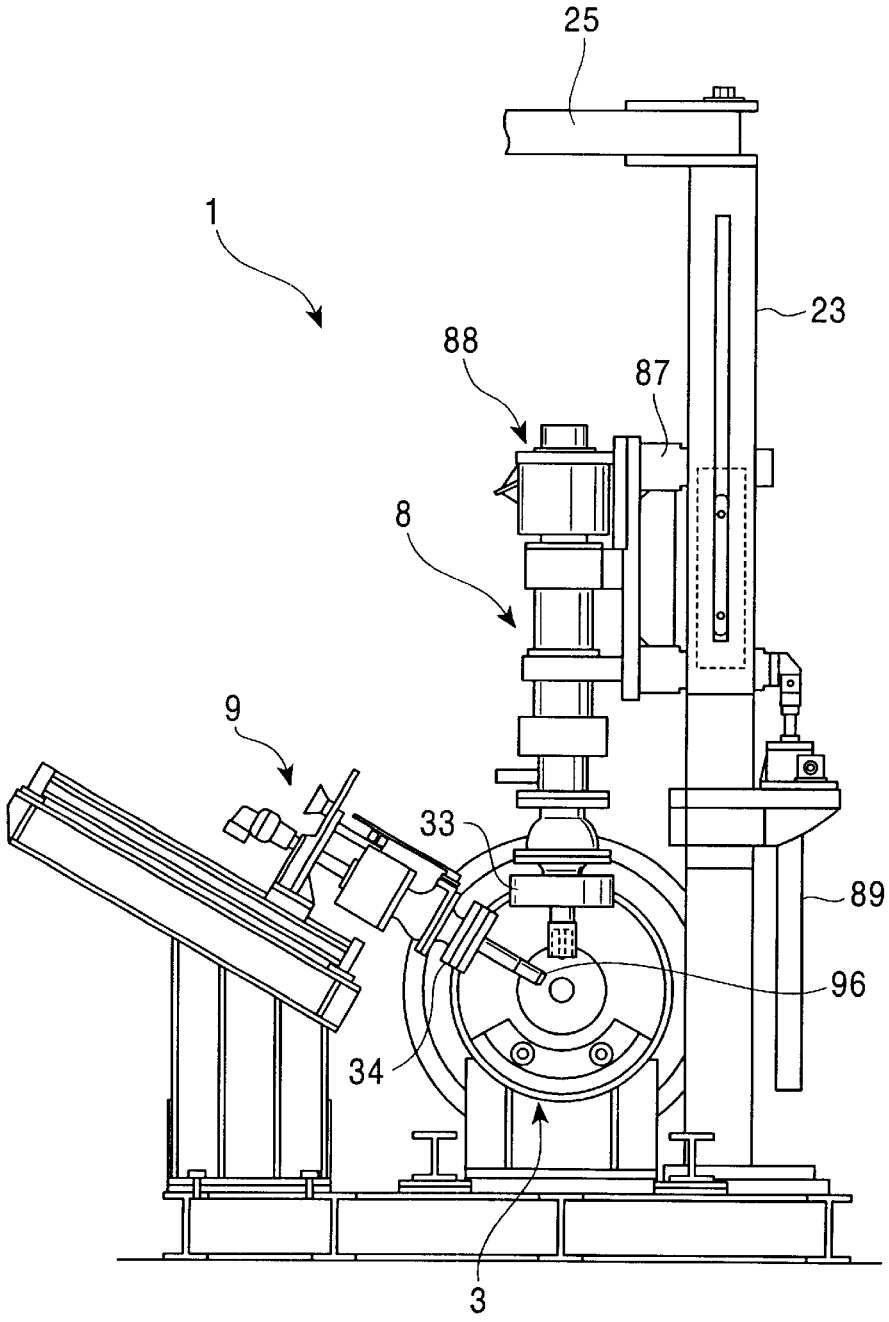
FIG. 2 is a sectional view taken along the line I—I in FIG. 1.
Figure 3:
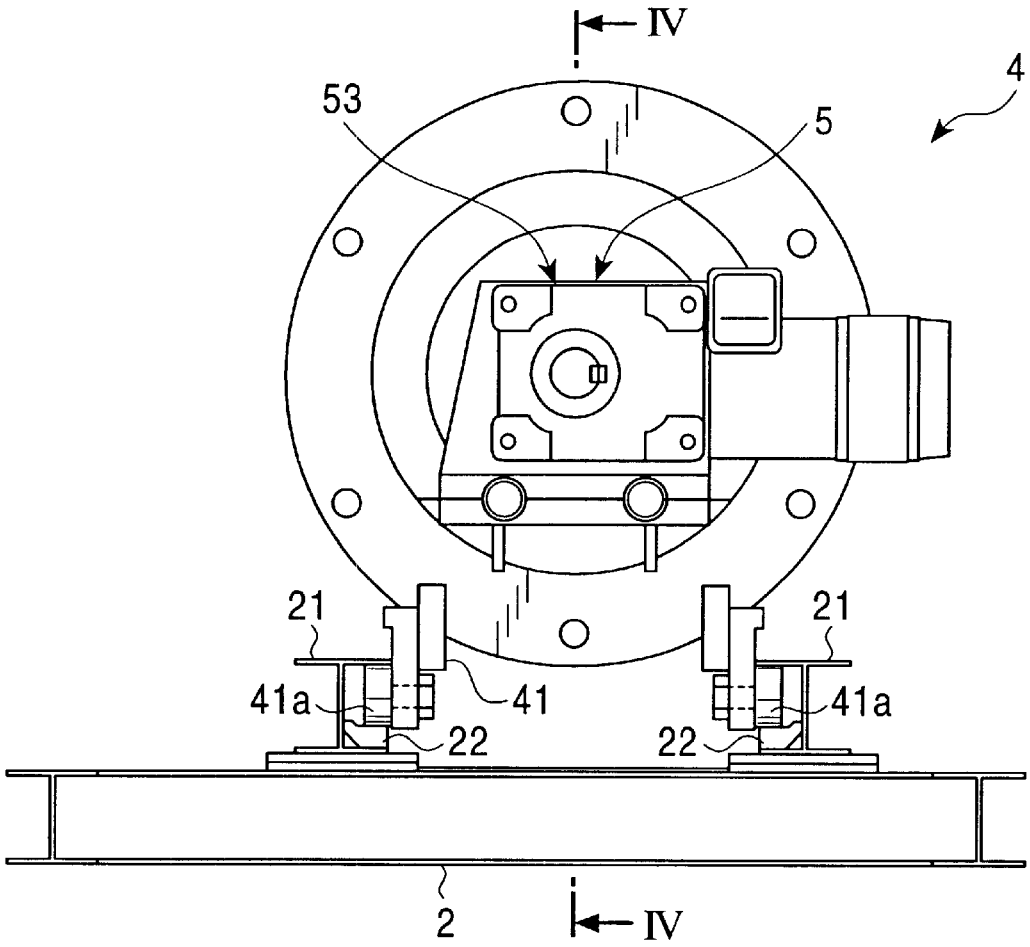
FIG. 3 is a view as viewed in the direction of arrow III in FIG. 1.
Figure 4:
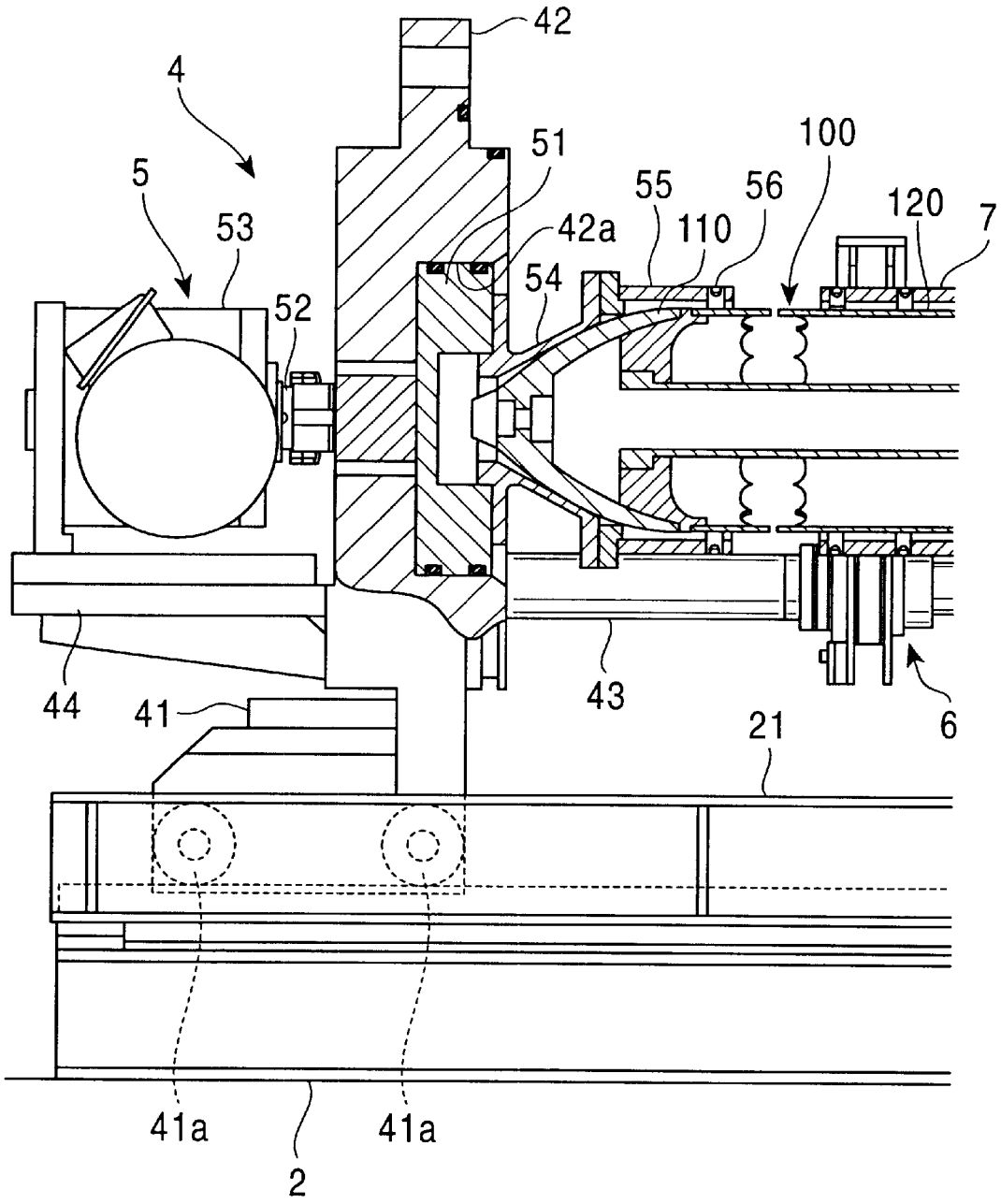
FIG. 4 is a sectional view taken along the line IV—IV in FIG. 3.
Figure 5A:
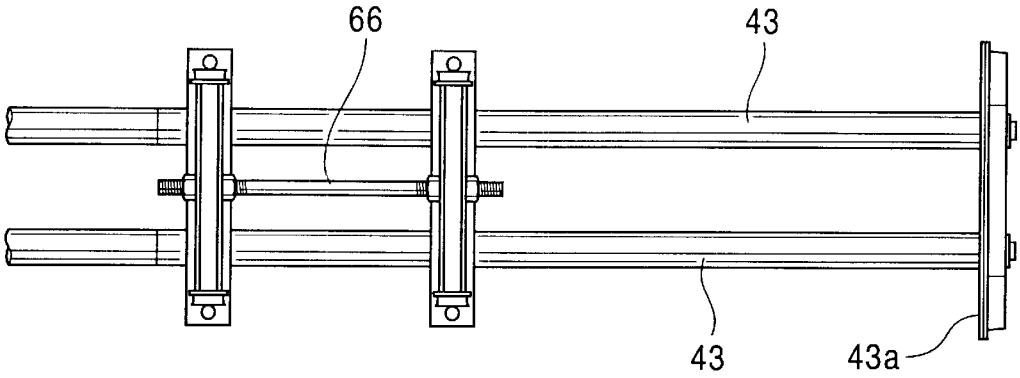
Figure 5B:
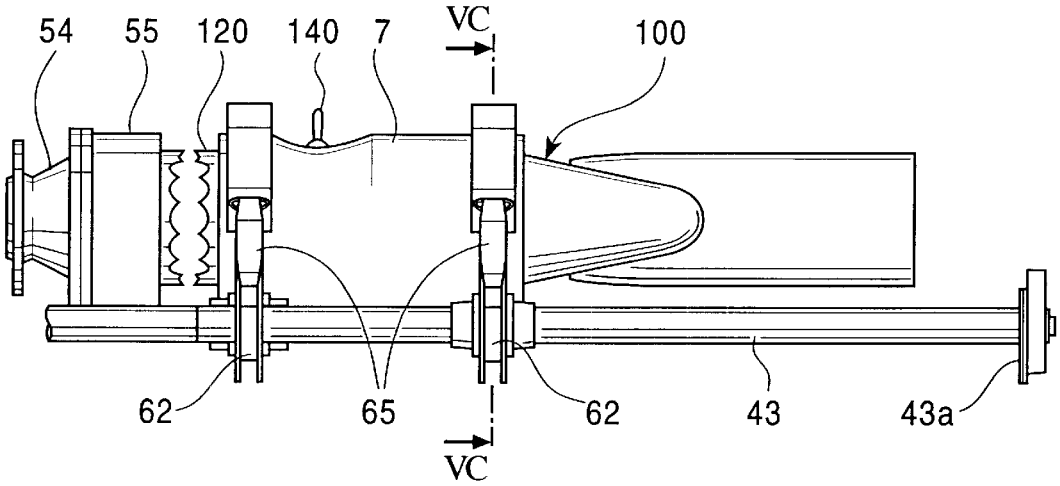
Figure 5C:
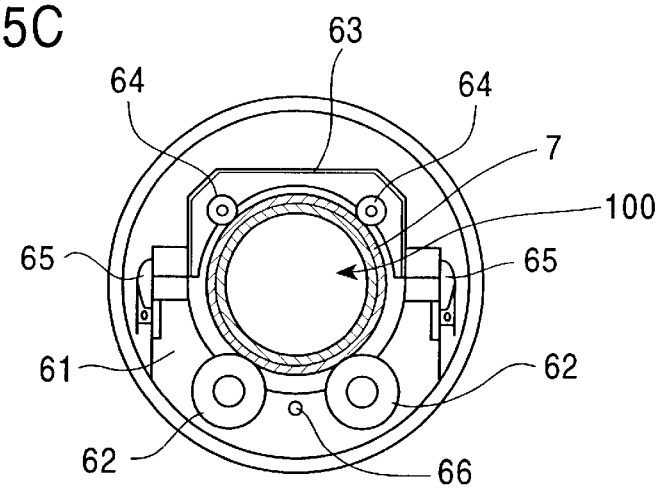
Figure 6A:
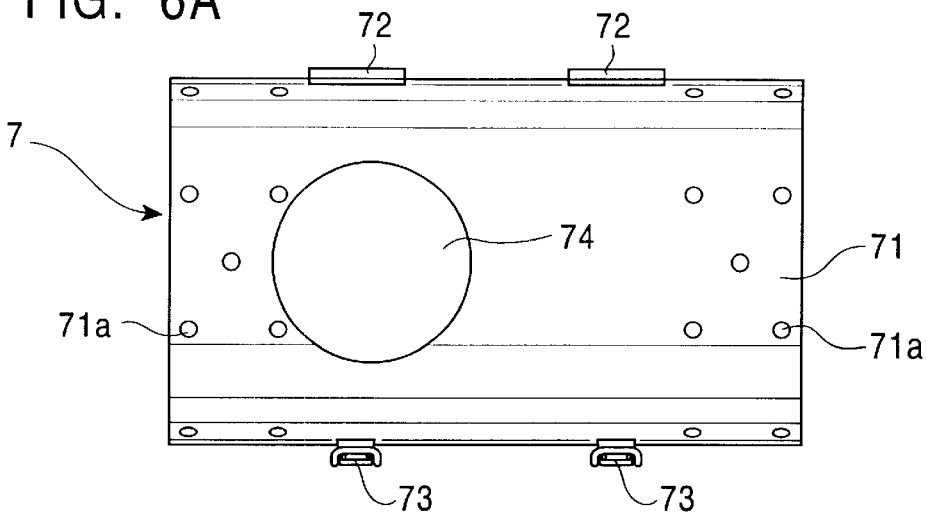
Figure 6B:
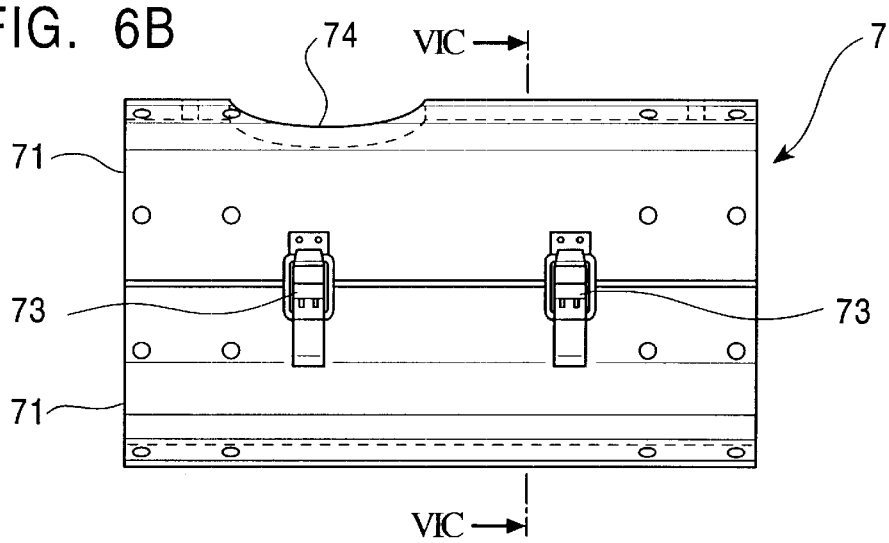
Figure 6C:
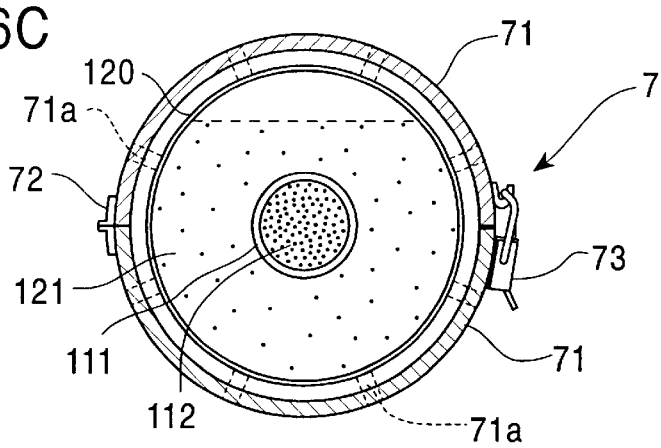
Figure 7:
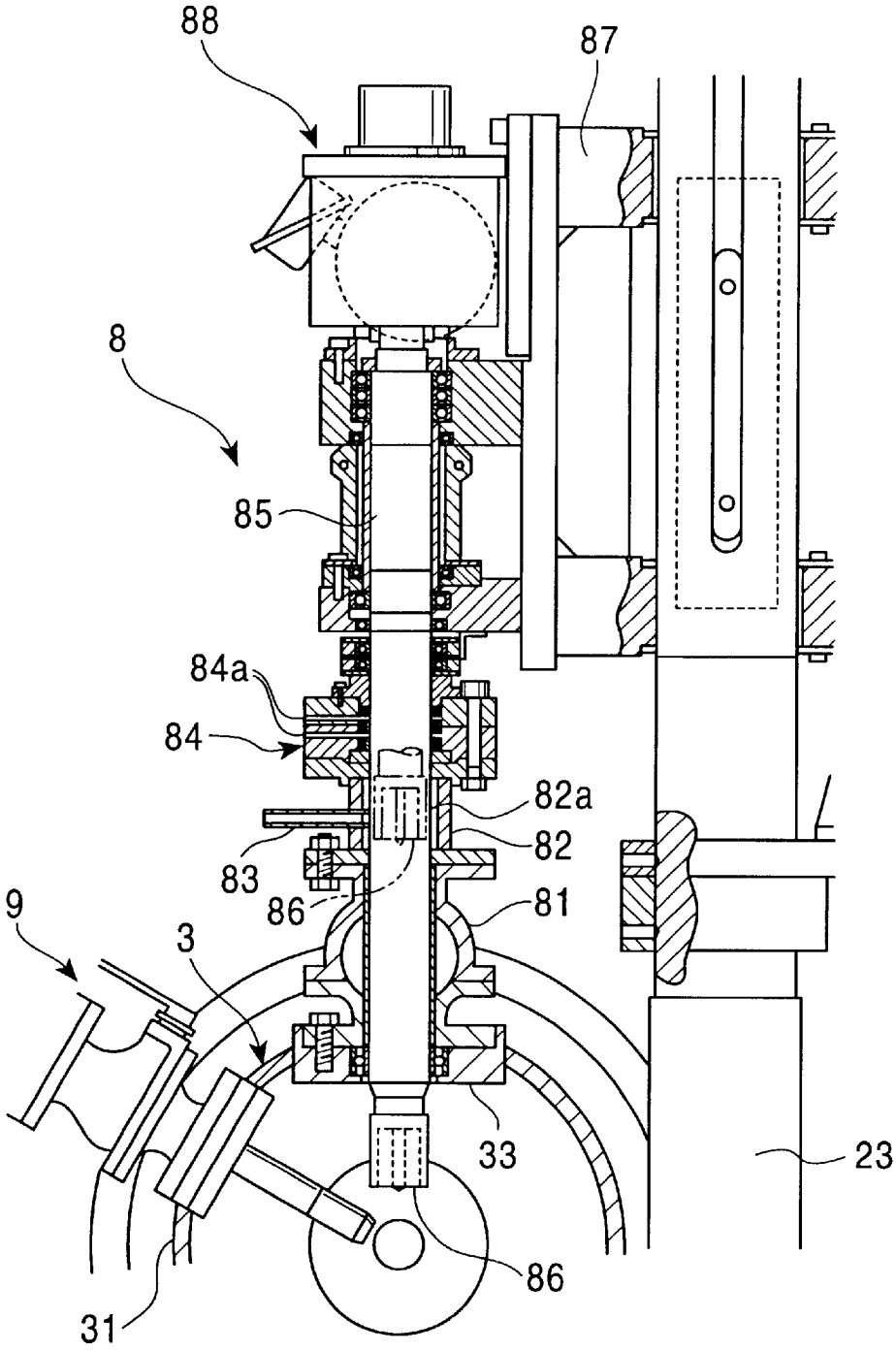
FIG. 7 is an explanatory view, sectioned in principal parts, of the construction of a boring and cutting apparatus in the installation for dismantling chemical bombs according to the embodiment of the present invention.
Figure 8:
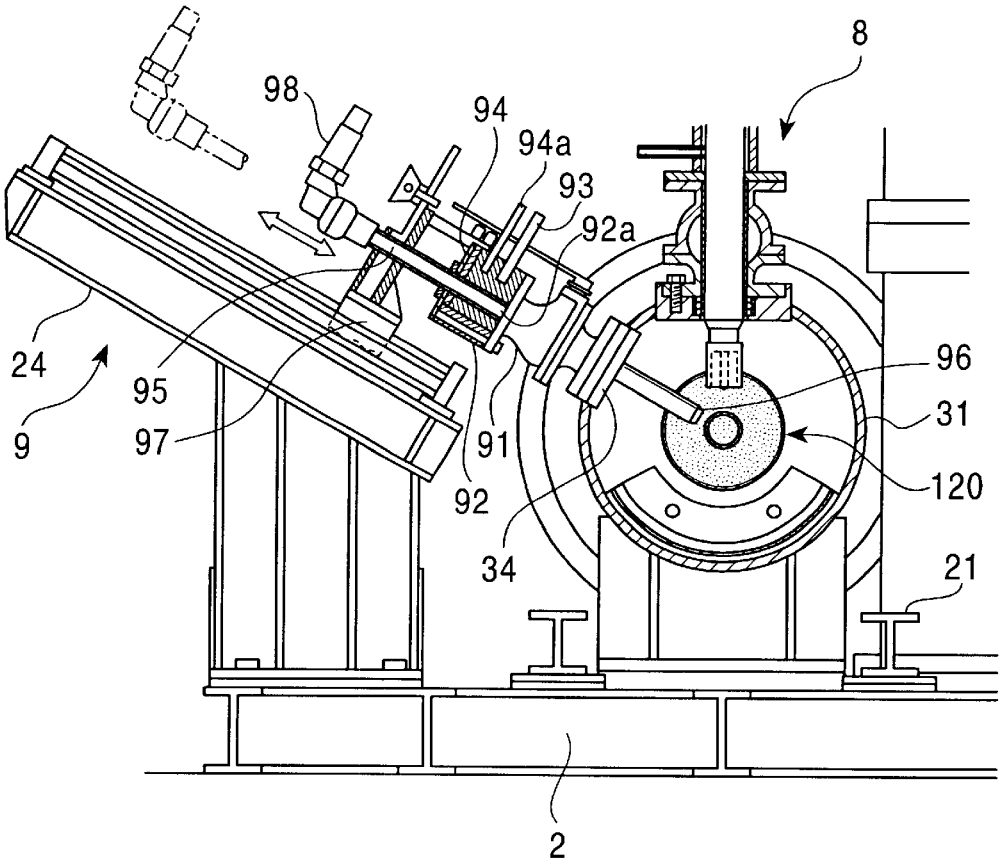
FIG. 8 is an explanatory view, sectioned in principal parts, of the construction of a neutralizer spraying apparatus in the installation for dismantling chemical bombs according to the embodiment of the present invention.

An embodiment of the present invention will be described below with reference to the drawings, in which FIG. 1 is an explanatory view, sectioned in principal parts, of the overall construction of an installation for dismantling chemical bombs according to the embodiment of the present invention, showing a state where the chemical bomb is placed in a container and a state where the chemical bomb is withdrawn out of the container after a bomb body shell has been cut; FIG. 2 is a sectional view taken along the line I—I in FIG. 1; FIG. 3 is a view as viewed in the direction of arrow III in FIG. 1; FIG. 4 is a sectional view taken along the line IV—IV in FIG. 3; FIG. 5A is a plan view of bomb support rods provided with a bomb supporting mechanism; FIG. 5B is a side view of the bomb support rods provided with the bomb supporting mechanism which is holding the chemical bomb; FIG. 5C is a sectional view taken along the line VC—VC in FIG. 5B; FIG. 6A is a plan view of a barrel holder; FIG. 6B is a side view of the barrel holder; FIG. 6C is a sectional view taken along the line VIB—VIB in FIG. 6B; FIG. 7 is an explanatory view, sectioned in principal parts, of the construction of a boring and cutting apparatus; FIG. 8 is an explanatory view, sectioned in principal parts, of the construction of a neutralizer spraying apparatus; and FIGS. 9 to 23 are explanatory views for explaining procedures of a process for dismantling the chemical bomb.

A chemical bomb to be dismantled by the installation for dismantling chemical bombs according to this embodiment is of the same structure as that described in connection with the related art. Therefore, a description regarding the structure of the chemical bomb is omitted herein, and the same reference numerals are employed for the chemical bomb in the following description.

First, a general outline of the installation for dismantling chemical bombs according to this embodiment will be described with reference to FIGS. 1 and 2. Numeral 1 denotes the installation for dismantling chemical bombs according to this embodiment. The chemical bomb dismantling installation 1 is installed on a frame-shaped mount base 2.

On the mount base 2, a container 3 having a cylindrical barrel 31 is disposed to accommodate a chemical bomb 100 in such an attitude that a warhead 110 is directed outwards, i.e., toward a container entrance. Connected to the container 3 is a neutralizer circulating line 12 (see FIG. 16) for circulating a neutralizer (neutralizing liquid) to a neutralizer spraying apparatus 9 (described later), from which the neutralizer is sprayed into a body shell 120 of the chemical bomb 100, with a neutralizer tank 11 (see FIG. 16) interposed in the neutralizer circulating line 12. Also, the container 3 is provided with a neutralizer return port 35 which has also the function of supplying cleaning water to the container 3, an inert gas supply port 36 to which an inert gas supply line (not shown) is connected for supplying inert gas for drying, a liquid discharge port 37 to which a liquid discharge line (not shown) is connected for discharging the neutralizer or the cleaning water, and a vent port 38 for discharging the inert gas supplied through the inert gas supply port 36.

At a position on the mount base 2 in front of an inlet/outlet opening 32 of the container 3, a bomb holding apparatus 4 (described later) is disposed to hold the chemical bomb 100 thereon such that the chemical bomb 100 can be loaded and unloaded into and from the container 3 through the inlet/outlet opening 32 together with the bomb holding apparatus 4.

A first port flange 33 is provided in an outer periphery of the barrel 31 of the container 3. Mounted to the first port flange 33 is a boring and cutting apparatus 8 (described later) for boring a cut hole in the body shell 120 of the chemical bomb 100 and cutting an outer periphery of the bomb body shell 120 for separation thereof from the warhead 110. Also, a second port flange 34 is provided in the outer periphery of the barrel 31 of the container 3 at a position that is spaced from the inlet/outlet opening 32 of the container 3 by the same distance as the first port flange 33, but is angularly out of phase with respect to the first port flange 33 by a predetermined angle (60° in this embodiment). Mounted to the second port flange 34 is the neutralizer spraying apparatus 9 (described later) provided with a neutralizer spraying nozzle 96 which is inserted in the cut hole bored by the boring and cutting apparatus 8 to spray a neutralizer, i.e., an alkaline solution such as ammonia and sodium hydroxide, for neutralizing a chemical agent 121 filled in the bomb body shell 120 so that the toxic chemical agent is made harmless.

The bomb holding apparatus 4 is constructed as shown in FIGS. 1 and 3 to 5.

The bomb holding apparatus 4 includes a traveling carriage 41 having wheels 41*a* provided at ends thereof in the back-and-forth directions on both sides. The wheels 41*a* roll over a pair of rails 22 laid on upper surfaces of lower flanges, which locate on the sides facing each other, of a pair of H-steels 21 disposed on the mount base 2 to extend horizontally. The traveling carriage 41 supports thereon a bomb rotating mechanism 5 (described later) for rotating the chemical bomb 100 about its longitudinal axis, and also mounts thereon a flange-shaped airtight closing lid 42 for closing the inlet/outlet opening 32 of the container 3 in an airtight sealed condition. From the airtight closing lid 42, there are extended a pair of bomb support rods 43 provided with a bomb supporting mechanism 6 (described later) for supporting the chemical bomb 100 rotatably about the longitudinal axis. In this embodiment, the airtight closing lid 42 is fixed to the bomb holding apparatus 4, and this structure is advantageous in expediting the dismantling operation. The airtight closing lid 42, however, may be constructed so as to operate independently of the bomb holding apparatus 4.

The bomb rotating mechanism 5 includes a rotary disk 51 to which a rotary flange 54 is detachably attached for rotating the chemical bomb 100 about the longitudinal axis.

The rotary disk 51 is fitted to a circular bottom-equipped fitting hole 42*a*, which is formed in the airtight closing lid 42, with seal rings inserted in seal ring grooves formed in an outer periphery of the rotary disk 51. A disk driving apparatus 53 is disposed on a base plate 44 projecting from the airtight closing lid 42 on the side opposite to the bomb support rods 43. The disk driving apparatus 53 comprises a speed reducer, including a worm and a worm wheel, and a motor for driving the speed reducer. A rotary shaft 52 of the rotary disk 51 is projected out of the airtight closing lid 42 on the opposite side to the rotary flange 54 attached to the rotary disk 51, and is rotated by the disk driving apparatus 53.

As shown in FIG. 4, a cylindrical warhead holder 55 is fitted over the chemical bomb 100 from the side of the warhead 110 and is coupled to the rotary flange 54. The warhead holder 55 has a plurality of setscrews 56 disposed on an outer periphery of the warhead holder 55 at an end thereof opposite to the side, where the warhead holder 55 is coupled to the rotary flange 54, for pressing an outer peripheral surface of the body shell 120 of the chemical bomb 100 at a position near the warhead 110.

With such an arrangement, torque of the rotary disk 51 is transmitted to the chemical bomb 100 through the rotary flange 54 and the warhead holder 55, whereby the chemical bomb 100 can be freely rotated about the longitudinal axis. In other words, even if the outer peripheral surface of the body shell 120 of the chemical bomb 100 is rugged, or even if it is flattened, the bomb body shell 120 can be gripped by the plurality of setscrews 56 so that the torque of the rotary disk 51 is reliably transmitted to the chemical bomb 100.

As shown in FIGS. 5A, 5B and 5C, the bomb supporting mechanism 6 provided on the pair of bomb support rods 43 includes a pair of clamping means (described later) which are spaced from each other at a predetermined interval by an interval holding rod 66, and which embrace a cylindrical barrel holder 7 (described later), fitted over the body shell 120 of the chemical bomb 100, thereby supporting the chemical bomb 100 in a rotatable manner. Additionally, a scraper 43*a* is fixed to fore ends of the pair of bomb support rods 43 for scraping chips and dust produced during the boring and cutting of the chemical bomb 100 and rust peeled off from the chemical bomb 100 out of the container 3.

Each of the clamping means comprises a pair of receiving rollers 62 slidably supported by the pair of bomb support rods 43 and being rotatable about the bomb support rods 43 for supporting the barrel holder 7 in a rotatable condition, and a receiving saddle 61 partly cut out to have a semicircular inner periphery in a complementary relation to a lower outer peripheral surface of the barrel holder 7. Also, the clamping means comprises a retaining saddle 63 detachably fixed to the receiving saddle 61 through latches 65 and partly cut out to have a semicircular inner peripheral surface in a complementary relation to an upper outer periphery of the barrel holder 7. The retaining saddle 63 has a pair of retaining rollers 64 for retaining the barrel holder 7 in a rotatable condition.

When the barrel holder 7 is clamped by the clamping means, the lower outer peripheral surface of the barrel holder 7 is received by the receiving rollers 62 and the upper outer peripheral surface of the barrel holder 7 is retained by the retaining rollers 64. Accordingly, the chemical bomb 100 can be smoothly rotated together with the barrel holder 7. Further, during the boring operation to bore a cut hole by the boring and cutting apparatus 8, the chemical bomb 100 can be kept from moving unintentionally and hence from causing troubles in the boring operation.

As shown in FIGS. 6A, 6B and 6C, the barrel holder 7 comprises a pair of half-cylindrical members 71 obtained by splitting a cylinder to two halves, these half-cylindrical members 71 being joined to each other by hinges 72 provided on one side. By turning the two half-cylindrical members 71 about hinge pins of the hinges 72 to mate open ends of the half-cylindrical members 71 with each other and fastening latches 73 provided on the other side opposite to the hinges 72, the half-cylindrical members 71 form a cylindrical barrel. In thicker wall portions of those two half-cylindrical members 71, two rows of screw holes are bored in each of both end portions of the half-cylindrical members 71 at predetermined intervals in the circumferential direction, and setscrews 71*a* are meshed in the screw holes.

By tightening the setscrews 71*a*, the chemical bomb 100 can be reliably held inside the barrel holder 7 even if the outer peripheral surface of the bomb body shell 120 is rugged, or even if it is flattened. Additionally, a cutout hole 74 formed in the upper one of the two half-cylindrical members 71 serves to avoid interference between the barrel holder 7 and the lift ring 140 provided on the body shell 120 of the chemical bomb 100.

The boring and cutting apparatus 8 is constructed as shown in FIG. 7. More specifically, a ball valve 81 serving as an opening/closing valve is attached to the first port flange 33 provided on the barrel 31 of the container 3. A casing 82 having a cutter accommodating room 82*a* defined therein is attached to the ball valve 81. Above the casing 82, there is provided a shaft sealing device 84 which includes a plurality of seal rings and seal ring retainers, and which has an inert gas supply port 84*a* for supplying inert gas to a seal ring accommodating room. Further, a neutralizer supply port 83 for supplying the neutralizer is provided midway the casing 82 in the vertical direction.

A cutter rotating shaft 85 having a cutter 86 attached to its fore end for boring a circular cut hole is fitted through the shaft sealing device 84 in a rotatable and slidable manner.

The cutter rotating shaft 85 is constructed to be able to move the cutter 86 up and down reciprocally over a range from the cutter accommodating room 82*a* to a position where the cutter 86 can bore the circular cut hole in the bomb body shell 120, while passing through a valve opening hole formed in an opening/closing ball of the ball valve 81. A cutter driving apparatus 88, which comprises a speed reducer, including a worm and a worm wheel, and a motor for driving the speed reducer, is attached to an elevator stand 87 capable of moving up and down while it is guided by a post-like vertical guide 23 erected on the mount base 2 at a position near the container 3. An upper end of the cutter rotating shaft 85 is connected to an output portion of the speed reducer of the cutter driving apparatus 88.

An electric cylinder 89 for moving the elevator stand 87 up and down is attached, as shown in FIG. 2, to the post-like vertical guide 23 through a bracket so as to extend vertically. Further, a chain block support beam 25 is horizontally cantilevered to the top of the post-like vertical guide 23 in such a manner as able to turn about a vertical pivot shaft. When loading the chemical bomb 100 to be dismantled on the bomb holding apparatus 4, or when unloading the chemical bomb 100 having been dismantled from the bomb holding apparatus 4, a chain block (not shown) for lifting up the chemical bomb 100 through the lift ring 140 or a wire rope is attached to the chain block support beam 25.

The reason why this embodiment is constructed to supply the inert gas to the seal ring accommodating room of the shaft sealing device 84 is to reliably prevent a leakage of the gasified chemical agent through the shaft sealing device 84. Also, the reason why the neutralizer is supplied to the cutter accommodating room 82*a* when the cutter 86 is housed in the cutter accommodating room 82*a*, is to completely neutralize the chemical agent adhering to the cutter 86, thereby reliably ensuring safety in the replacing operation of the cutter 86. Of course, when the cutter 86 is housed in the cutter accommodating room 82*a* for replacement of the cutter 86 and the neutralizer is supplied to the cutter accommodating room 82*a*, the ball valve 81 is closed by operating an associated lever.

Since the cutter 86 of the boring and cutting apparatus 8 is just movable up and down, it is only possible to bore a circular cut hole in the body shell 120 of the chemical bomb 100 by the cutter 86. Cutting of the body shell 120 of the chemical bomb 100 is performed as follows.

After holding the chemical bomb 100 on the bomb holding apparatus 4 with the aid of the bomb supporting mechanism 6 through the barrel holder 7, the bomb holding apparatus 4 is moved into the container 3 and one cut hole is bored, as described above, in the body shell 120 of the chemical bomb 100 placed in the container 3. The cutter 86 is then retracted to a position away from the bomb body shell 120. Subsequently, the chemical bomb 100 is rotated by the bomb rotating mechanism 6 through an angular distance slightly smaller than the diameter of the cutter 86, and then stopped at a position where two adjacent holes are bored in an overlapped relation. At that position, another cut hole is bored likewise by the boring and cutting apparatus 8. By repeating such a step of boring a cut hole, the bomb body shell 120 is cut throughout its periphery.

The neutralizer spraying apparatus 9 is constructed as shown in FIG. 8. More specifically, a ball valve 91 serving as an opening/closing valve is attached to the second port flange 34 provided on the barrel 31 of the container 3. A casing 92 having a nozzle accommodating room 92*a* defined therein is attached to the ball valve 91. Above the casing 92, there is provided a shaft sealing device 94 which includes a plurality of seal rings and seal ring retainers, and which has an inert gas supply ports 94*a* for supplying inert gas to a seal ring accommodating room. Further, a neutralizer supply port 93 for supplying the neutralizer to the nozzle accommodating room 92*a* is provided in the shaft sealing device 94 closer to the container 3 than the inert gas supply port 94*a*.

A nozzle rod 95 having a neutralizer spray nozzle 96 attached to its fore is fitted through the shaft sealing device 94 in a slidable manner. The nozzle rod 95 is constructed to be able to move the neutralizer spray nozzle 96 reciprocally over a range from the nozzle accommodating room 92*a* to a position where the neutralizer spray nozzle 96 can spray the neutralizer into the bomb body shell 120, while passing through a valve opening hole formed in an opening/closing ball of the ball valve 91 and the circular cut hole bored in the bomb body shell 120 by the cutter 86. The nozzle rod 95 is attached at a portion neat its upper end to a rod moving stand 97 capable of moving reciprocally while it is guided by a sloped guide 24 disposed on the mount base 2 at a position near the container 3. A neutralizer supply line 98 for supplying the neutralizer is connected to an end of the nozzle rod 95 projected out of the rod moving stand 97.

The reason why this embodiment is constructed to supply the inert gas to the seal ring accommodating room of the shaft sealing device 94 is to reliably prevent a leakage of the gasified chemical agent through the shaft sealing device 94. Also, the reason why the neutralizer is supplied to the nozzle accommodating room 92*a* when the neutralizer spray nozzle 96 is housed in the nozzle accommodating room 92*a*, is to completely neutralize the chemical agent adhering to the neutralizer spray nozzle 96, thereby reliably ensuring safety in the replacing operation of the neutralizer spray nozzle 96. Of course, when the neutralizer spray nozzle 96 is housed in the nozzle accommodating room 92*a* for replacement of the neutralizer spray nozzle 96 and the neutralizer is supplied to the nozzle accommodating room 92*a*, the ball valve 91 is closed. As understood from the above description, the foregoing points are exactly the same as in the construction of the boring and cutting apparatus 8.

A process for dismantling a chemical bomb by the chemical bomb dismantling installation according to this embodiment will be described below with reference to FIGS. 9 to 23 in sequence.

Figure 9:
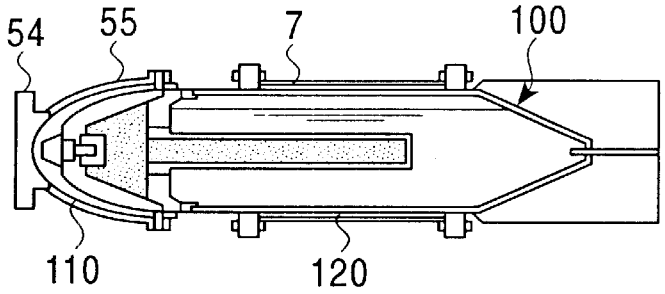
FIG. 9 is an explanatory view for explaining procedures of a process for dismantling the chemical bomb.

FIG. 9 shows a state in the preparatory stage for dismantling the chemical bomb 100. The rotary flange 54 and the warhead holder 55 are attached to the warhead 110 side of the chemical bomb 100, and the barrel holder 7 is fitted over the body shell 120 of the chemical bomb 100.

Figure 10:
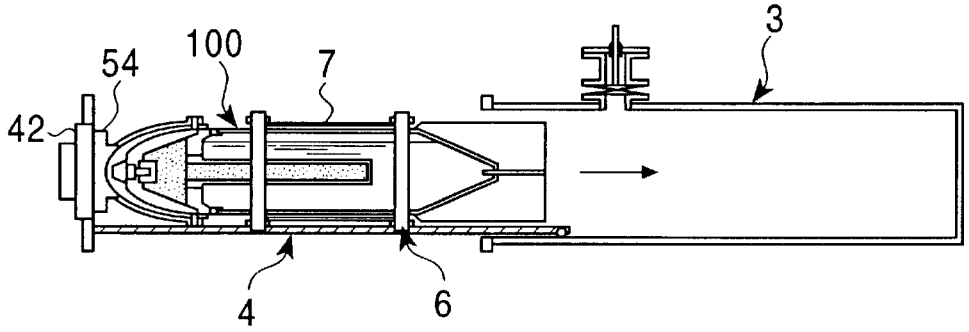
FIG. 10 is an explanatory view for explaining procedures of the process for dismantling the chemical bomb.

FIG. 10 shows a state in the course of the operation of placing the chemical bomb 100 into the container 3. The rotary flange 54 is fixed by bolts to the rotary disk which is rotatably supported by the airtight closing lid 42 of the bomb holding apparatus 4, and the barrel holder 7 fitted over the bomb body shell 120 is rotatably supported by the bomb supporting mechanism 6, the receiving rollers of the receiving saddle and the retaining rollers of the retaining saddle. Then, the bomb holding apparatus 4 is moved toward the container 3 along the rails.

Figure 11:
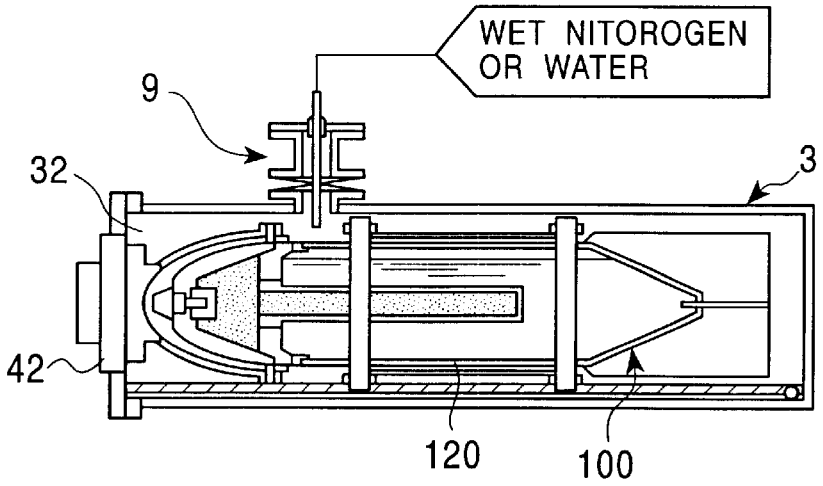
FIG. 11 is an explanatory view for explaining procedures of the process for dismantling the chemical bomb.

FIG. 11 shows a state after the chemical bomb 100 has been placed in the container 3 but before a cut hole is bored in the body shell 120 of the chemical bomb 100. The chemical bomb 100 is placed in the container 3, and the inlet/outlet opening 32 of the container 3 is hermetically sealed by the airtight closing lid 42.

Prior to starting to bore a cut hole in the body shell 120 of the chemical bomb 100, wet nitrogen or water is supplied into the container 3 from the neutralizer spraying apparatus 9. The reason why wet nitrogen or water is supplied into the container 3 prior to starting to bore a cut hole in the bomb body shell 120 is to prevent an excessive temperature rise of the cutter 86 and to prevent the occurrence of sparks during the work of boring the cut hole.

Figure 12:
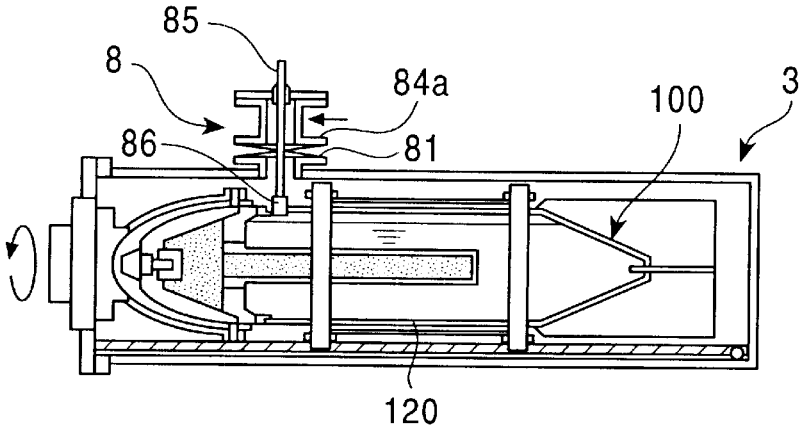
FIG. 12 is an explanatory view for explaining procedures of the process for dismantling the chemical bomb.

FIG. 12 shows a state during the work of boring a cut hole in the body shell 120 of the chemical bomb 100. Nitrogen gas as inert gas is supplied to the seal ring accommodating room of the shaft sealing device through the inert gas supply port 84*a*, and the ball valve 81 of the boring and cutting apparatus 8 is opened in a condition of completely preventing a leakage of the chemical agent through the shaft sealing device. Then, the cutter rotating shaft 85 is moved downward while being rotated to bore a cut hole in the body shell 120 of the chemical bomb 100 at an arbitrary position by the cutter 86.

Subsequently, the cutter rotating shaft 85 is retracted from the bomb body shell 120 and the chemical bomb 100 is rotated 90° by the bomb rotating mechanism. Thereafter, the cutter rotating shaft 85 is moved downward again while being rotated to bore a next cut hole. By repeating such a step of boring a cut hole each time the chemical bomb 100 has been rotated 90°, cut holes are bored in the body shell 120 of the chemical bomb 100 at four positions along the outer periphery thereof. Note that the number of cut holes is not limited to four, and it is just required to bore cut holes at two or more positions.

Figure 13:
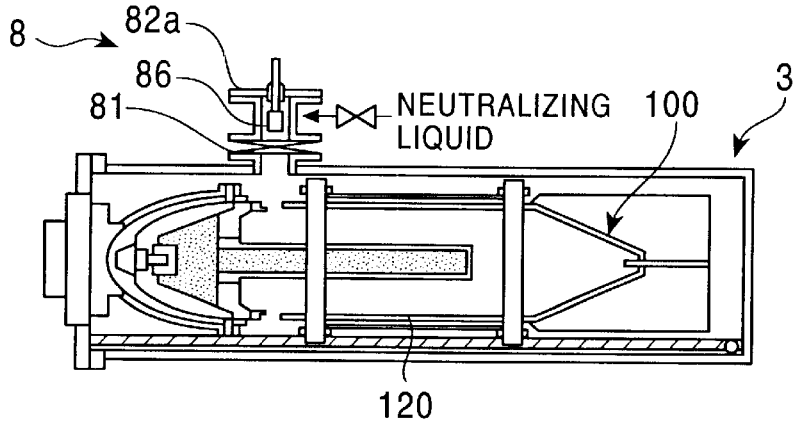
FIG. 13 is an explanatory view for explaining procedures of the process for dismantling the chemical bomb.

FIG. 13 shows a state where the work of boring the cut holes is finished and the cutter 86 is housed in the cutter accommodating room 82*a*. The ball valve 81 is closed and the neutralizer is supplied to the cutter accommodating room 82*a* through the neutralizer supply port 83, whereby the chemical agent adhering to the cutter 86 is neutralized so as to become harmless.

Figure 14:
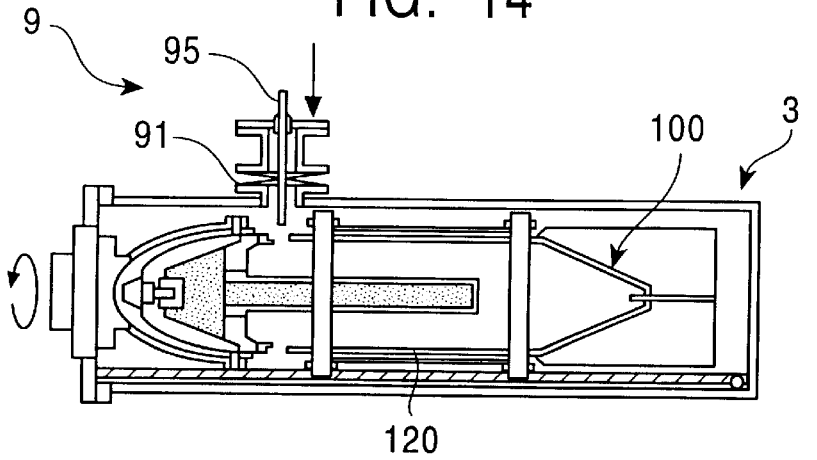
FIG. 14 is an explanatory view for explaining procedures of the process for dismantling the chemical bomb.

FIG. 14 shows a state in the preliminary stage for spraying the neutralizer into the body shell 120 of the chemical bomb 100 by the neutralizer spraying apparatus 9. After rotating the chemical bomb 100 by the bomb rotating mechanism through such an angle as enabling the nozzle rod 95 of the neutralizer spraying apparatus 9 to be inserted in one cut hole, the ball valve 91 is opened and the nozzle rod 95 of the neutralizer spraying apparatus 9 is moved downward obliquely.

Figure 15:
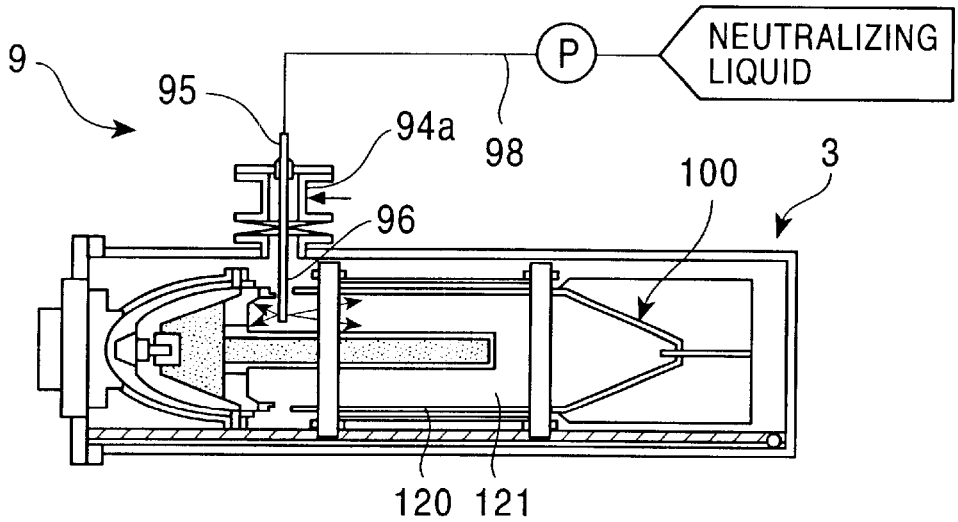
FIG. 15 is an explanatory view for explaining procedures of the process for dismantling the chemical bomb.

FIG. 15 shows a state in the stage for spraying the neutralizer into the body shell 120 of the chemical bomb 100 by the neutralizer spraying apparatus 9. The nozzle rod 95 is inserted into the body shell 120 of the chemical bomb 100 through the cut hole, and the neutralizer is supplied to the nozzle rod 95 from the neutralizer supply line 98 for spraying the neutralizer through the neutralizer spray nozzle 96 to neutralize the chemical agent 121 within the bomb body shell 120, while nitrogen gas as inert gas is supplied to the seal ring accommodating room of the shaft sealing device through the inert gas supply port 94*a* for completely preventing a leakage of the chemical agent through the shaft sealing device.

Figure 16:
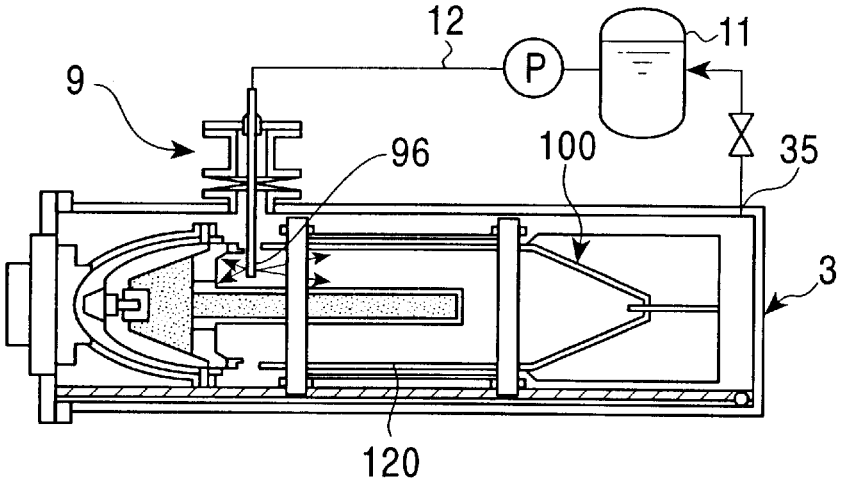
FIG. 16 is an explanatory view for explaining procedures of the process for dismantling the chemical bomb.

FIG. 16 shows a state where the neutralizer in the container 3 is circulated. The neutralizer in the container 3 is supplied to the neutralizer spraying apparatus 9 via the neutralizer circulating line 12, which includes the neutralizer tank 11 interposed midway the line 12 and is connected to the neutralizer return port 35, so that the neutralizer is continuously sprayed into the bomb body shell 120 through the neutralizer spray nozzle 96. In other words, the neutralizer is continuously recirculated between the container 3 and the neutralizer tank 11.

Figure 17:
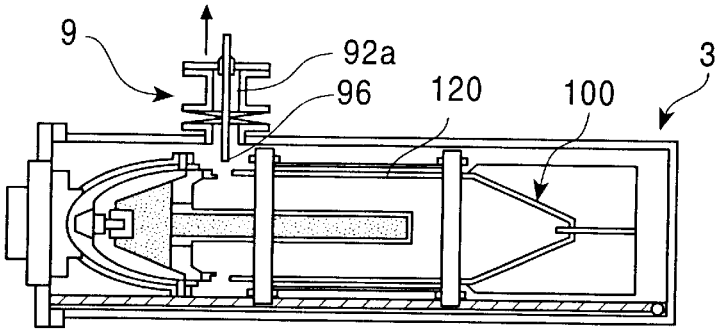
FIG. 17 is an explanatory view for explaining procedures of the process for dismantling the chemical bomb.

FIG. 17 shows a state in the course of the operation of returning the neutralizer spray nozzle 96 into the nozzle accommodating room 92*a*. Spraying of the neutralizer is stopped and the neutralizer spray nozzle 96 is retracted away from the bomb body shell 120.

Subsequently, the work steps described above with reference to FIGS. 14 to 17 are performed in an exactly similar manner for all of the remaining three cut holes bored in the body shell 120 of the chemical bomb 100. By repeating those operations of spraying and circulating the neutralizer, the chemical agent is reliably neutralized so as to become harmless.

Figure 18:
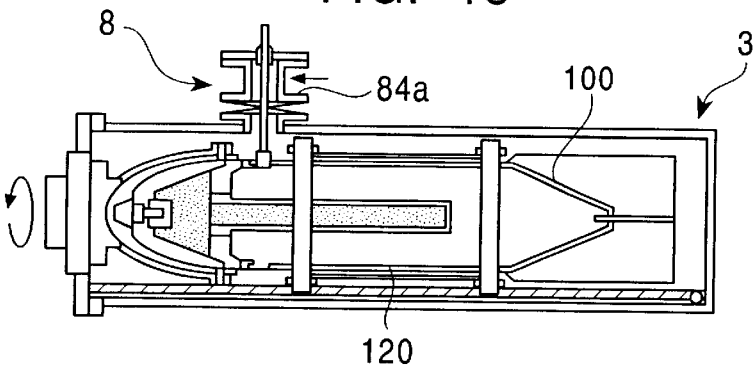
FIG. 18 is an explanatory view for explaining procedures of the process for dismantling the chemical bomb.

FIG. 18 shows a state in the stage for cutting the bomb body shell 120 by the boring and cutting apparatus 8. Under a condition of supplying nitrogen gas to the seal ring accommodating room of the shaft sealing device through the inert gas supply port 84*a*, cut holes are successively bored in an overlapped relation in the bomb body shell 120 for separation thereof from the warhead 110 while the chemical bomb 100 is rotated by the bomb rotating mechanism at predetermined angular intervals.

Figure 19:
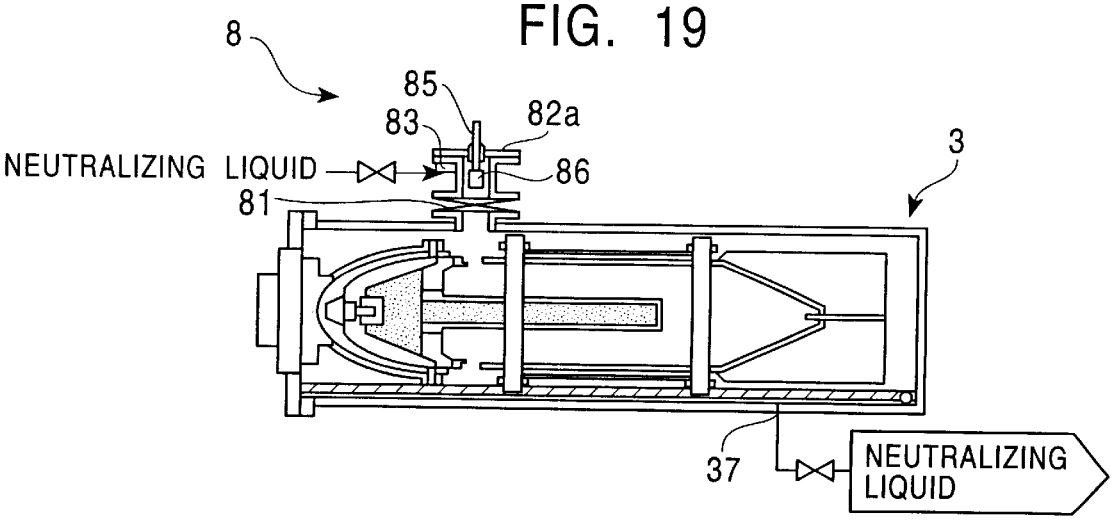
FIG. 19 is an explanatory view for explaining procedures of the process for dismantling the chemical bomb.

FIG. 19 shows a state in the stage for discharging the neutralizer in the container 3 through the liquid discharge port 37. The cutter rotating shaft 85 of the boring and cutting apparatus 8 is moved upward for retracting the cutter 86 into the cutter accommodating room 82*a*, and the ball valve 81 is closed. For higher reliability of safety, the neutralizer is then supplied to the cutter accommodating room 82*a* through the neutralizer supply port 83. Even if the chemical agent still remains adhered to the cutter 86, it is thereby neutralized so as to ensure safety in the replacing operation of the cutter 86.

In parallel with the work of neutralizing the cutter 86 as described above, the neutralizer in the container 3 is discharged through the liquid discharge port 37.

Figure 20:
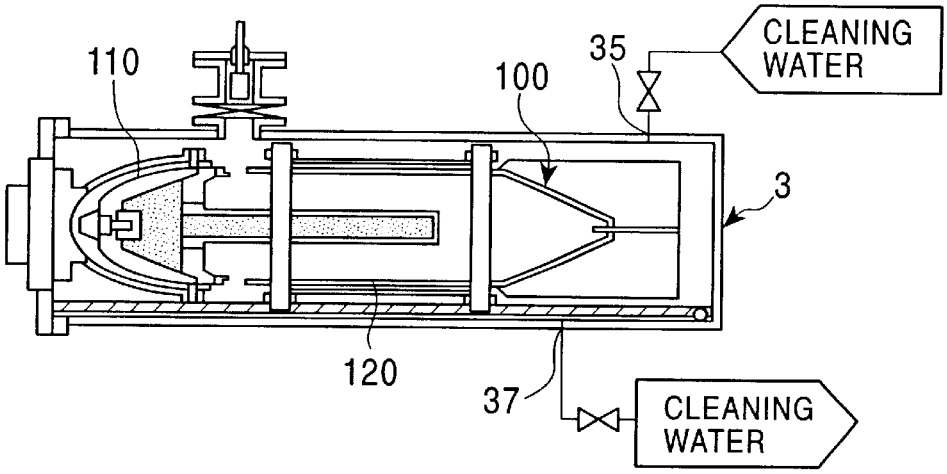
FIG. 20 is an explanatory view for explaining procedures of the process for dismantling the chemical bomb.

FIG. 20 shows a state in the stage for cleaning the interior of the container 3 and the chemical bomb 100 having been cut. Cleaning water is supplied into the container 3 through the neutralizer return port 35 to fill the container 3 with the cleaning water, thereby cleaning the interior of the container 3 and the chemical bomb 100 having been cut. Thereafter, the cleaning water in the container 3 is discharged through the liquid discharge port 37.

Figure 21:
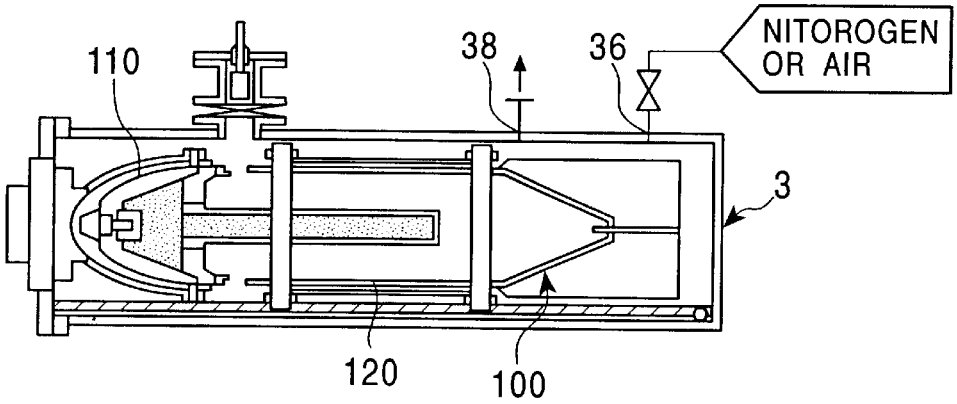
FIG. 21 is an explanatory view for explaining procedures of the process for dismantling the chemical bomb.

FIG. 21 shows a state in the stage for drying the interior of the container 3 and the chemical bomb 100 having been cut. Nitrogen gas or air (dried air) for drying is supplied into the container 3 through the inert gas supply port 36 to dry the interior of the container 3 and the warhead 110 and the body shell 120 of the chemical bomb 100 having been cut. Wetted nitrogen gas or air is discharged through the vent port 38.

Figure 22:
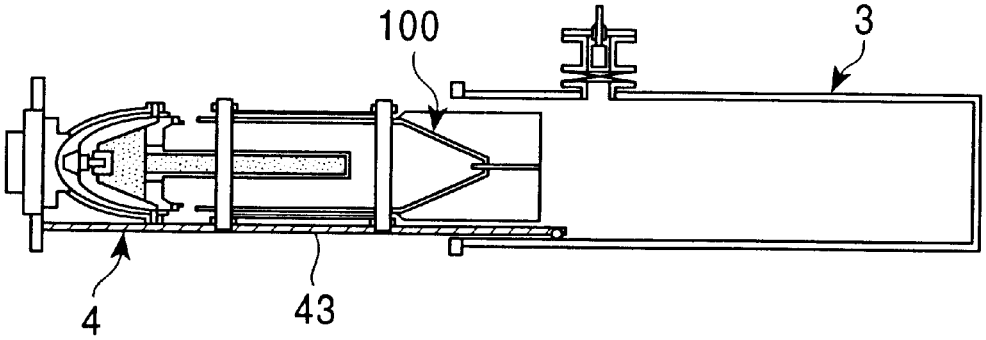
FIG. 22 is an explanatory view for explaining procedures of the process for dismantling the chemical bomb.

FIG. 22 shows a state in the stage for withdrawing the chemical bomb 100 having been cut out of the container 3. By pulling the bomb holding apparatus 4 from the container 3, the chemical bomb 100 is withdrawn out of the container 3. At this time, chips, dust and peeled-off rust having dropped onto an inner peripheral bottom surface of the container 3 from the chemical bomb 100 is scraped out by the scraper 43*a* fixed to the fore end of the bomb support rods 43.

Figure 23:
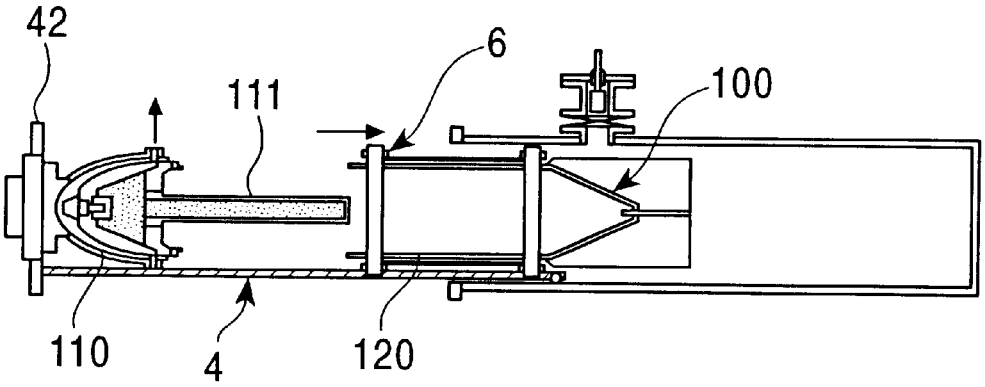
FIG. 23 is an explanatory view for explaining procedures of the process for dismantling the chemical bomb.
Figure 24:
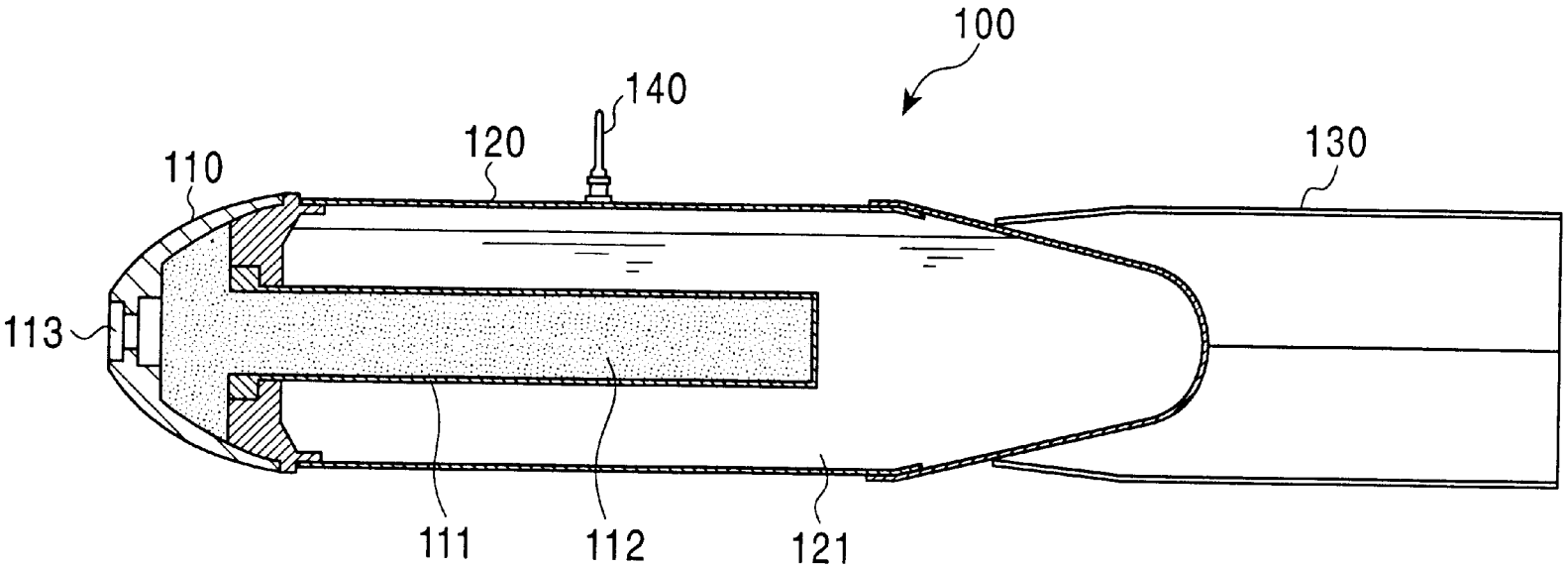
FIG. 24 is an explanatory view, sectioned in principal parts, of the structure of a chemical bomb.

FIG. 23 shows a state in the stage for separating the warhead 110 and the body shell 120 of the chemical bomb 100 having been cut farther away from each other. The bomb supporting mechanism 6 supporting the bomb body shell 120 is slid to move along the bomb support rods 43 in the direction away from the warhead 110 until the explosive tube 111 is completely withdrawn out of the bomb body shell 120. The bomb body shell 120 is thereby separated farther away from the warhead 110.

Subsequently, the rotary flange 54 is removed from the rotary disk 51 rotatably supported by the opening/closing lid 42, and the warhead 110 is removed from the bomb holding apparatus 4. Then, the bomb supporting mechanism 6 is slid to move toward the opening/closing lid 42. The bomb body shell 120 is removed from the receiving saddle and the retaining saddle, and the bomb body shell 120 is removed from the bomb holding apparatus 4 together with the barrel holder 7. The warhead 110 thus removed from the bomb holding apparatus 4 is destroyed by blasting it in an explosion chamber, and the bomb body shell 120 is subjected to melting treatment. As a result, a series of steps for dismantling one piece of chemical bomb 100 is completed.

Because the chemical agent is neutralized by the neutralizer during the operation of dismantling the chemical bomb

100, salts are separated out in the container 3 depending on the kinds of chemical agent and neutralizer.

The separated salts are discharged to the outside of the container 3 through the liquid discharge port 37 together with the neutralizer and the cleaning water. Most of the discharged neutralizer and cleaning water is however used again as cleaning water for the repeated process.

To that end, the neutralizer and the cleaning water are each stored in a salt sedimentation tank, and water cleaned through sedimentation of the salts in the tank is reused as cleaning water.

With the above-described installation 1 for dismantling chemical bombs according to this embodiment, the chemical agent can be neutralized by the neutralizer so as to become harmless, while a leakage of the chemical agent from the container 3 is reliably prevented. Further, since the body shell 120 of the chemical bomb 100 is separated from the warhead 110 by the dismantling operation, the warhead 110 and the bomb body shell 120 can be treated by respective suitable methods depending on their properties.

Thus, the installation 1 for dismantling chemical bombs according to this embodiment enables the chemical bomb 100 to be dismantled with very high safety. Since the operation of dismantling the chemical bomb 100 can be speedy performed without a fear of causing harms on human bodies, it is possible to provide a very excellent advantage in greatly improving the efficiency of the operation of dismantling the chemical bomb 100 and hence to remarkably contribute to dealing with the negative inheritance from the past, i.e., the chemical bomb 100.

In the foregoing description, the chemical bomb 100 is dismantled, for example, by first boring cut holes at four positions in the body shell 120 of the chemical bomb 100 placed in the container 3, then inserting the nozzle rod 95 in each of the cut holes to spray the neutralizer through the neutralizer spray nozzle 96, and then circulating the sprayed neutralizer. As an alternative, however, the chemical bomb 100 may be dismantled by first cutting the body shell 120 of the chemical bomb 100 placed in the container 3 with the boring and cutting apparatus 8 while rotating the chemical bomb 100, then inserting the nozzle rod 95 in a cut portion to spray the neutralizer through the neutralizer spray nozzle 96, and then circulating the sprayed neutralizer. This modification can also provide similar advantages as those obtainable with the above-described embodiment.

According to the installation for dismantling chemical bombs of the present invention, as fully described above, a chemical agent can be neutralized by a neutralizer so as to become harmless, while a leakage of the chemical agent from a container is reliably prevented. Furthermore, a body shell of the chemical bomb is separated from a warhead by the dismantling operation, whereby the warhead and the bomb body shell can be treated by respective suitable methods depending on their properties. The chemical bomb can be therefore dismantled with very high safety. Since the operation of dismantling the chemical bomb can be speedy performed without a fear of causing harms on human bodies, the present invention is very advantageous in greatly improving the efficiency of the operation of dismantling the chemical bomb and hence remarkably contributes to dealing with the negative inheritance from the past, i.e., the chemical bomb.

What is claimed is:

1. An installation for dismantling a chemical bomb including a body shell filled with a chemical agent, the installation comprising:

a container capable of accommodating said chemical bomb in an airtight sealed condition;

a bomb holding apparatus for holding said chemical bomb rotatably about a longitudinal axis thereof and placing said held chemical bomb into said container,;

a boring and cutting apparatus provided on a barrel of said container for boring a cut hole in the body shell of said chemical bomb placed in said container and/or cutting an outer periphery of said bomb body shell to separate said bomb body shell from a warhead; and a neutralizer spraying apparatus having a spray nozzle for spraying a neutralizer to the interior of said bomb body shell through the cut hole or portion bored or cut by said boring and cutting apparatus.

2. An installation for dismantling a chemical bomb according to claim 1, wherein said container has a neutralizer return port for returning the neutralizer to said neutralizer spray nozzle.

3. An installation for dismantling a chemical bomb according to claim 1, wherein said container includes means for supplying cleaning water into said container, and a liquid discharge port for discharging the neutralizer and/or the cleaning water.

4. An installation for dismantling a chemical bomb according to claim 1, wherein said container has an inert gas supply port for supplying inert gas for drying, and a vent port for discharging the inert gas supplied through said inert gas supply port.

5. An installation for dismantling a chemical bomb according to claim 1, wherein said bomb holding apparatus comprises:

a traveling carriage;

an airtight closing lid provided on said traveling carriage and detachably attached to said container to close said container in an airtight sealed condition;

a pair of bomb support rods extended from said airtight closing lid;

a bomb rotating mechanism provided in said airtight closing lid and rotating said chemical bomb about the longitudinal axial thereof; and a bomb supporting mechanism disposed on said pair of bomb support rods to be able to slide in the longitudinal direction of said bomb support rods, and having receiving rollers and retaining rollers to support said chemical bomb rotatably about the longitudinal axis thereof through a cylindrical barrel holder fitted over said chemical bomb.

6. An installation for dismantling a chemical bomb according to claim 1, wherein said boring and cutting apparatus comprises:

an opening/closing valve attached to a first port flange provided on the barrel of said container;

a casing attached to said opening/closing valve and having a cutter accommodating room for accommodating a cutter to bore a circular cut hole in said bomb body shell;

a shaft sealing device for maintaining said casing in an airtight sealed condition; and a cutter rotating shaft penetrating through a seal ring accommodating room of said shaft sealing device and moving said cutter, which is detachably attached to a fore end of said cutter rotating shaft, up and down between said cutter accommodating room and a position where said cutter is able to bore the cut hole in said bomb body shell, while passing through said opening/closing valve.

7. An installation for dismantling a chemical bomb according to claim 6, wherein said seal ring accommodating room is communicated with an inert gas supply port for supplying inert gas therethrough.

8. An installation for dismantling a chemical bomb according to claim 6, wherein said cutter accommodating room is communicated with a neutralizer supply port for supplying the neutralizer therethrough.

9. An installation for dismantling a chemical bomb according to claim 1, wherein said neutralizer spraying apparatus comprises:

an opening/closing valve attached to a second port flange provided on the barrel of said container;

a casing attached to said opening/closing valve and having a nozzle accommodating room for accommodating a neutralizer spray nozzle;

a shaft sealing device for maintaining said casing in an airtight sealed condition; and a nozzle rod penetrating through a seal ring accommodating room of said shaft sealing device and moving said neutralizer spray nozzle, which is provided at a fore end of said nozzle rod, reciprocally between said nozzle accommodating room and a position where said neutralizer spray nozzle is able to spray the neutralizer into said bomb body shell, while passing through said opening/closing valve and the cut hole bored in said bomb body shell.

10. An installation for dismantling a chemical bomb according to claim 9, wherein said seal ring accommodating room is communicated with an inert gas supply port for supplying inert gas therethrough.

11. An installation for dismantling a chemical bomb according to claim 9, wherein said nozzle accommodating room is communicated with a neutralizer supply port for supplying the neutralizer therethrough.

* * * * *